United States Patent [19]

Anderson et al.

[11] 4,176,430

[45] Dec. 4, 1979

[54] SELVAGE STRIP LIFTING DEVICE

[76] Inventors: Harvey G. Anderson, 1264 Dogwood Dr., Bridgewater, N.J. 08807; Karl E. Pannaci, 27 Raplh St., Highlands, N.J. 07732

[21] Appl. No.: 895,995

[22] Filed: Apr. 13, 1978

[51] Int. Cl.[2] ..... D06C 3/10

[52] U.S. Cl. ..... 26/96; 83/155.1; 198/693

[58] Field of Search ..... 26/96; 83/155.1; 198/693

[56] References Cited

U.S. PATENT DOCUMENTS

| | | | |
|---|---|---|---|
| 2,086,392 | 7/1937 | Remington | 26/11 |
| 2,477,431 | 7/1949 | Vollenweider | 26/12 |
| 2,594,919 | 4/1952 | Hadley | 26/12 |
| 2,598,579 | 5/1952 | McCutchen et al. | 139/291 C |
| 2,962,791 | 12/1960 | Remington | 26/10.4 |
| 3,164,879 | 1/1965 | Sprungli | 26/10.4 |
| 3,224,313 | 12/1965 | Mohring | 26/96 X |
| 3,417,444 | 12/1968 | McCreary | 26/96 |
| 3,460,212 | 8/1969 | Elsas et al. | 26/10.4 |

FOREIGN PATENT DOCUMENTS

| | | | |
|---|---|---|---|
| 2153734 | 5/1923 | Fed. Rep. of Germany | 26/96 |
| 1092430 | 11/1960 | Fed. Rep. of Germany | 26/96 |
| 1460725 | 9/1969 | Fed. Rep. of Germany | 26/96 |
| 2054927 | 5/1971 | France | 26/96 |
| 1019553 | 2/1966 | United Kingdom | 26/96 |

*Primary Examiner*—Robert Mackey

[57] ABSTRACT

In a preferred embodiment, an elongated base element has as a part thereof, a hinge mechanism mounting a lever for pivotal movement of the lever by a handle whenever movement of the base element causes the handle to strike a cam mounted in the path of movement of the handle attached to the mounted lever, and there being spaced-apart screw-receiving holes in the elongated base element at spaced dimensions such that the screw-receiving holes are alignable with screw-mounting holes in a traveling base and in the selvage pin-mounts and strip carrying the pins, whereby the traveling base is with ease and economically mountable between the strip carrying the pins and the elongated base element, with the lever including a plurality of portions extending across a width of the strip carrying the pins, and with the handle extending downwardly beneath the elongated base element, the lever extending above the elongated base element and above the pin-carrying strip, adapted such that the plurality of portions lying beneath a pinned selvage strip is adapted to lift the selvage strip from a mounted state on the pins to a free state above the pins whenever pressure on the handle causes the lever to pivot the plurality of portions upwardly.

3 Claims, 8 Drawing Figures

SELVAGE STRIP LIFTING DEVICE

This invention relates to a selvage strip lifting mechanism and structure for stripping cut-away selvage strip from the its mounted state on upright pins mounted by a pin-carrying strip that is mounted on an upper surface of a traveling belt, or link or like.

BACKGROUND TO THE INVENTION

Prior to the present invention, gripper rollers were at one time utilized to draw-away cut-off selvage strip from its mounted state on pins carried by a moving belt structure, and subsequently suction or vacuum mechanisms substantially replaced gripper rollers, from which suction device the selvage strip was fed into a waste pile or container. However, with either and both of the noted mechanisms, not infrequently the selvage strip would not be successfully stripped from the pins, hanging on the pins as the belt or chain links moved forwardly with a resulting undesirable time-consuming and expensive shut-down of the entire mechanism of a stretching process and procedure. As an effort to overcome such undesirable shut-downs, there was developed a spring of which the base was fixedly-mounted on an underside of each link, and an end portion of the spring became pushed-up between the consecutive links in the space there-between; however, the spring-end moving upward to lift the selvage strip upwardly, was not desirably close or among the pins, merely lifting between the consecutive links and thus did not always disengage the selvage strip from the pins, and also the consecutive repeated flexing of the pivot-point portion of the mounted spring eventually and too quickly caused the spring arm to break-off, further requiring frequent replacements; see U.S. Pat. No. 3,417,444. Another embodiment was developed which included grinding-away a recess in the upper-face of the link structure or lower face of the pin-carrying strip, and passing an arm therethrough having a lifting arm on one end thereof and a handle on the other end against which a cam would cause the arm to move and the lever to lift selvage strip by a passing of the lever across the face of the pin-carrying strip between the pins themselves beneath the selvage strip; the primary difficulty with such embodiment was the great loss in time and labor required to grind-down the seating slot for the the arm to extend therethrough, as well as the shut-down time while each link or pin-carrying strip was dismantled and ground-down. Also, while such was a functional improvement, it did not always work perfectly to disengage the selvage strip from the mounting pins.

THE INVENTION

Objects of the present invention include the overcoming and avoiding of problems and difficulties of the preceding mechanisms, together with the obtaining of novel advantages and structures not heretofore available.

In particular, an object of the present invention is to obtain an improved lifter of selvage strip from engaging pins.

Another object is to obtain a lifter of selvage strip of a structure easily and quickly mountable without requiring grinding of parts in order for a belt or link or pin-mounting structure to accomodate and mount the novel lifter device of this invention.

A more particular object of the invention is to retain the desirable feature of a freely pivoting lever arm while concurrently obtaining a secure and sturdy mounting utilizing already-existing mounting features of the pin-mounting structure and the mounting base belt or link.

Another object is to obtain a simple mechanism and structure assuring return of a lifting arm to the lowered seated state.

Other objects become apparent from the preceding and following disclosure.

One or more objects are obtained by the invention as set-forth in the preceding and following disclosure typically as illustrated but not limited to the illustrative embodiments shown in the accompanying drawings of the Figures described hereinafter.

Broadly, the invention may be described as a selvage strip lifting device for use in the stripping away of the selvage strip from the mounted state on the selvage-mounting pins carried on a moving belt or link (hereinafter, belt referring to either type structure), to a state of the selvage strip being free from attachment and engagement with the selvage-mounting pins. As is conventional in the art, the mechanism and processes for the stretching of fabrics and the like, involve the automatic machinery carrying a moving belt having upright pins mounted thereon, which upright devices are brought into engagement with pins which thereby secure the fabric onto opposite spaced-apart tracks and belts moving in a common direction but diverging from one-another with a resulting stretching effect. Upon completion of the stretching operation, the selvage at opposite edges of the stretched material is moved into engagement with a cutting blade which cuts-away a selvage-strip. The cut-away selvage strip is at that moment retained on the pins, to be later drawn by gripper rolls or suction mechanism to a disposal area. For the present invention, a cam structure is stationarily mounted on the machine or other support structure, at a point beneath the moving belt such that an arm of a pivot mechanism of the present invention is moved into engagement therewith with the resulting movement of a lever carried by the arm to pivot the lever upwardly against an under-face of the selvage strip thereby stripping the selvage strip from the pins.

The improvement of the present invention is an elongated base element having pivotably hinged thereon an arm of an interconnected handle element and a lever element which serves as a lifting arm for lifting the selvage strip from engagement with the mounting pins upon the pivoting upwardly of a distal end of the lever element as movement of the traveling-belt moves the handle against the cam, when the elongated base element is mounted on the traveling-belt, such that cam pressure on the handle causes the distal end of the handle to move upwardly toward a distal end of the elongated base element, and concurrently the lever distal end lifting portion is thereby caused to move upwardly away from a distal end of and above the elongated base element.

In one preferred embodiment, the lever is inclusive of a plurality of intermediate portions spaced-away from the point of pivot and extending transversely to the elongated longitudinal axis of the elongated base element, and with the handle axis extending away from the point of pivot.

Still another preferred embodiment includes mounting screw-receiving holes in the elongated base element having predetermined dimensions of spacing therebetween such that they are alignable with pre-existing holes in the pin-mounting strip and in the belt (or link of such belt); accordingly, the elongated base element is easily and speedily mountable by mere removal of mounting screws, placing the elongated base element between the pin-mounting strip and the belt (or link thereof), or alternately beneath the belt (or link thereof) to thereby be secured by insertion of the screws through screw-receiving holes.

The preferred embodiment having the plurality of portions of the lever extending transversely beneath the selvage strip, thereby provides the advantage of lifting the selvage strip at many points in series along the strip carrying the pins, with the result that snagging or retainably catching and failure of the selvage strip to disengage totally from the pins of the pin-mounting strip, is obviated, allowing high speed operation of the movement forwardly of the traveling-belt device without the danger of shut-down.

A further preferred embodiment includes a weight-structure of predetermined mass sufficient to cause the lever to fall downwardly back to the resting position as soon as cam pressure against the handle by the cam is released as the handle is carried past the cam member.

It is apparent that in a further preferred embodiment, a cam member is provided as a part of the combination, for making possible a quick producing of an operational unit from a machine previously devoid of such present invention.

The invention may be better understood by making reference to the following Figures illustrative of preferred and alternate embodiments of the invention.

THE DRAWING

Figures 1, 2, 3, 4A, 4B, 4C, 5, 6:
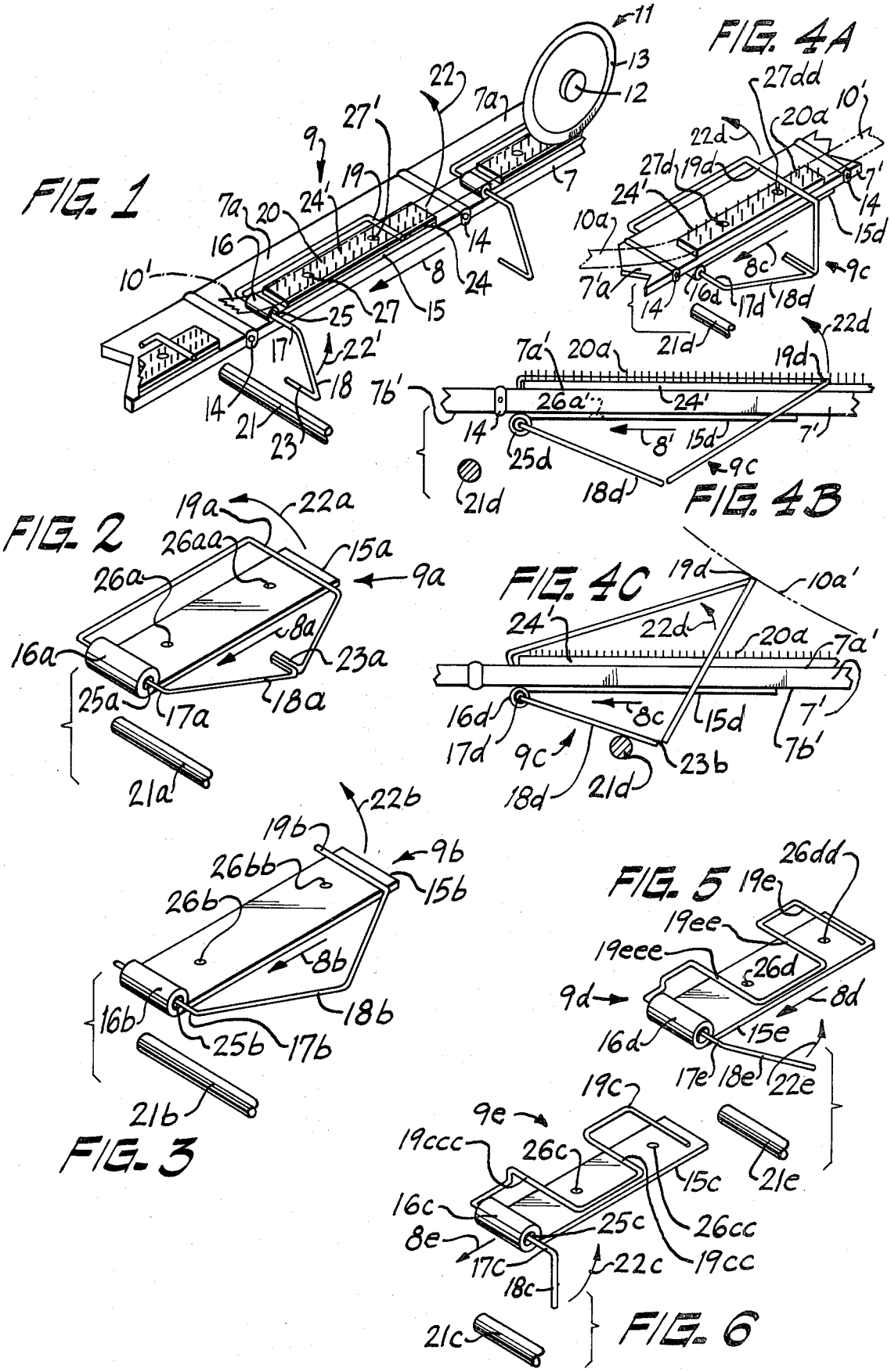
FIG. 1 illustrates symbolically and diagrammatically a machine embodying the present invention, shown in a front top perspective view.
FIG. 2 illustrates an alternate embodiment of the present invention, different from and preferred over that of FIG. 1, also shown in front top perspective view, diagrammatically.
FIG. 3 illustrates a still further alternate embodiment, also in a front top perspective view thereof, noting that the embodiments of FIGS. 2 and 3 both have an additional preferred feature of a more sturdily-braced handle, against which pressure of the cam member will be exerted, also shown diagrammatically.

FIG. 4A, FIG. 4B, and FIG. 4C, are different in-series progressive steps of operation of an alternate embodiment also shown in a mounted state on the traveling-belt link, in likewise, a front top perspective view, for FIG. 4A, and in a side view in also a digrammatic view thereof for each of the FIGS. 4B and 4C.

FIG. 5 illustrates a preferred embodiment having a plurality of intermediate portions spaced-apart aong the lever element, for improved lifting of the selvage strip, also diagrammatic.

FIG. 6 shows an embodiment substantially the same as the FIG. 5 embodiment, except with the preferred feature of a shorter handle element at a more advanced position thereby making possible equivalent lifting with the cam member being closer to the underside of the traveling-belt links, also diagrammatically illustrated, both FIGS. 5 and 6 also being a front top perspective view.

DETAILED DESCRIPTION

All figures refer to common parts with the exception of preferred features of some thereof relative to other embodiments, except that FIGS. 1 and 4A, 4B, and 4C additionally illustrate a traveling belt combination inclusive of the conventional link having its traveling base with a pin-supporting strip mounted on an upper face of the traveling base, and with the selvage-mounting pins extending upwardly from the pin-supporting strip's upper surface, and further inclusive as a preferred combination therewith, the novel selvage strip lifting device having its elongated base element mounted in FIG. 1 between the pin-supporting strip and the traveling base, and mounted in FIGS. 4A, 4B, and 4C beneath the lower surface of the traveling base, as shown. Accordingly, for substantially common parts in so far as function, corresponding indicia will be utilized.

FIG. 1 illustrates the traveling base 7 with its upper face *7a*, moving conventionally in direction 8, and having mounted thereon the novel selvage strip lifting device 9, over which the severed selvage strip 10 lies bound on pins 20 of the upper surface 24'. Note that the selvage strip is partially illustrated in phantom, as traveling along (mounted on) the pins, with the right (rearward) end still being fastened but with the free-portion 10' of the prior forward link being lifted from the pins, the still bound strip 10 of selvage having originated by the cutting blade 11, on shaft 12, by cutting edge 13. The belt includes connecting members 14 allowing the links in series to conventionally follow a curved path of travel. The elongated base elements 15 is mounted beneath the pin-supporting strip 24 on the traveling base 7, by screws 27' conventionally mounted in mounting apertures 27, through aligned holes (not viewable) as screw-receiving holes of the elongated base element 15. As an integral proximal-end portion of the elongated base element 15, is the tubular hinge structure 16 having interconnecting shaft 17 integrally a continuation of each of the lever element 19 and the handle element 18 with weight element 23, positioned to be moved-against cam member 21 to cause the lever element 19 to move in direction 22 as the handle element 18 moves in direction 22'. The interconnecting shaft 17 extends through through-space 25 of tubular hinge structure 16.

The embodiments of FIGS. 2, 3, and 6 illustrate the screw-receiving holes 26*a*, 26*aa*, 26*b*, 26*bb*, 26*c*, 26*cc*, as well as the same holes being shown in phantom as 26*a'* of FIG. 4B, and as 26*d* and 26*dd* in FIG. 5.

The embodiments of FIGS. 5 and 6 both have the preferred feature of the levers having a plurality of transverse portions 19*d*, 19*cc*, 19*ccc*, 19*e*, 19*ee*, 19*eee*, serving as consecutive serially arranged intermittent lifting portions for concurrently lifting the selvage strip from all the pins.

The embodiment of FIG. 6 has the handle element 19*c* extending more directly downwardly (or forwardly) than the handle element 19*e* of FIG. 5, the handle element 18*c* thus being purposely shorter, and the cam member being closer to the lower surface of the elongated base element 15*c* than the cam member 21*e* relative to the elongated base element 15*e*, while obtaining slightly-less force in lifting selvage strip by the lever portions 19*c*, 19*cc*, and 19*ccc*, but moving the lever portions through substantially the same arcuate distance as the embodiment of FIG. 5.

The FIGS. 4A, 4B, and 4C diagrammatically show the progressive stages of stripping-away the selvage strip 10' to the free-state 10*a* as the lever portion of lever 19*d* moves in direction 22*d* (FIGS. 4A and 4B).

It is within the scope of this invention to make substitution of equivalents and variations of ordinary skill.

We claim:

1. A selvage lifting device comprising in combination, for mounting on a fabric edge-carrying traveling-belt device including consecutive links adapted for moving fabric selvage past and into trimming contact with a selvage strip-producing cutting blade while a fabric edge is pin-mounted onto upwardly-extending pins of the consecutive links, and for lifting selvage residual strip from the pins of each link which includes an elongated base element having a free side-edge extending along a longitudinal axis of the base element, and the base element including a hinge means mounting pivotably a lever element having a handle element connected to the lever element adapted to impart pivotal motion thereto, with the lever element being connected to said handle element and mounted on said hinge means such that when pressure is applied to said handle element said lever element pivots rotatably around a hinge axis of the hinge means, the improvement comprising said lever element being mounted by said hinge means around said axis thereof such that the lever element pivots from an upper surface of the base element, with the lever element extending in a direction along said longitudinal axis and extending through said hinge axis to a point beyond said free edge, which hinge axis extends substantially transversely to said longitudinal axis, and the handle element extending beside said free edge from below a level of said base element to the point said, and the handle element being positioned to pivot in a direction extending along said longitudinal axis when pressure is applied thereto.

2. A selvage lifting device of claim 1, including a weight element of predetermined mass sufficient to return said lever to original position by action of gravity whenever there is no opposing pressure pressing against said handle element.

3. A selvage lifting device of claim 2, including a cam member substantially fixedly mounted relative to the movable traveling-belt device, positioned below the traveling-belt device in location such that the cam member presses against said handle element as the handle element moves against the cam element.

* * * * *